US007397390B2

(12) United States Patent
DiPiazza

(10) Patent No.: US 7,397,390 B2
(45) Date of Patent: Jul. 8, 2008

(54) WIRELESS TRAFFIC CONTROL SYSTEM

(75) Inventor: Gerald Charles DiPiazza, Edenton, NC (US)

(73) Assignee: M/A-COM, Inc., Lowell, MA (US)

( * ) Notice: Subject to any disclaimer, the term of this patent is extended or adjusted under 35 U.S.C. 154(b) by 271 days.

(21) Appl. No.: 10/891,893

(22) Filed: Jul. 15, 2004

(65) Prior Publication Data

US 2005/0280553 A1 Dec. 22, 2005

Related U.S. Application Data

(63) Continuation-in-part of application No. 10/869,411, filed on Jun. 16, 2004.

(51) Int. Cl.
*G08B 1/00* (2006.01)

(52) U.S. Cl. ..... 340/905; 340/906; 340/916; 340/917

(58) Field of Classification Search ..... 340/905, 340/901, 906, 916, 917
See application file for complete search history.

(56) References Cited

U.S. PATENT DOCUMENTS

| | | | | |
|---|---|---|---|---|
| 3,680,043 | A | 7/1972 | Angeloni | |
| 4,115,757 | A | 9/1978 | Blahunka | |
| 5,214,793 | A * | 5/1993 | Conway et al. | 455/500 |
| 5,926,114 | A | 7/1999 | Andrews | |
| 6,049,295 | A | 4/2000 | Sato | |
| 6,246,948 | B1 | 6/2001 | Thakker | |
| 6,344,828 | B1 | 2/2002 | Grantz et al. | |
| 6,396,417 | B2 | 5/2002 | Lee | |
| 6,452,533 | B1 | 9/2002 | Yamabuchi et al. | |
| 6,606,033 | B1 | 8/2003 | Crocker et al. | |
| 6,621,420 | B1 | 9/2003 | Poursartip | |
| 6,633,238 | B2 * | 10/2003 | Lemelson et al. | 340/909 |
| 6,707,391 | B1 | 3/2004 | Monroe | |
| 6,807,464 | B2 | 10/2004 | Yu et al. | |
| 6,909,893 | B2 | 6/2005 | Aoki et al. | |
| 2003/0025286 | A1 | 2/2003 | Meibock et al. | |
| 2003/0063015 | A1 | 4/2003 | Ebner et al. | |
| 2004/0130463 | A1 | 7/2004 | Bloomquist et al. | |
| 2004/0242087 | A1 | 12/2004 | Hoshina | |

FOREIGN PATENT DOCUMENTS

| | | |
|---|---|---|
| DE | 196 26 114 A1 | 1/1998 |
| WO | WO95/01607 | 1/1995 |

* cited by examiner

*Primary Examiner*—Daryl C Pope

(57) ABSTRACT

A wireless traffic control system and method for wirelessly communicating information using traffic control signs are provided. The method includes wirelessly transmitting at least one of traffic control information and vehicle information from a traffic control sign and wirelessly receiving the information transmitted from the traffic control sign by at least one other traffic control sign.

20 Claims, 3 Drawing Sheets

WIRELESS TRAFFIC CONTROL SYSTEM

CROSS REFERENCE TO RELATED APPLICATIONS

This application is a continuation-in-part of and claims priority to copending non-provisional U.S. Patent Application entitled "System and Method to Wirelessly Communicate Information Between Traffic Control Signs and Vehicles," assigned Ser. No. 10/869,411, and filed Jun. 16, 2004, which is hereby incorporated by reference in its entirety.

BACKGROUND OF THE INVENTION

This invention relates generally to traffic control systems, and more particularly, to traffic control systems providing wireless communication of information between a plurality of traffic control signs.

Drivers traversing roadways in their vehicles are provided with many different traffic control signs having traffic control information, such as, for example, sign-directed cautions, alerts and information. This traffic control information is typically provided along and above the roadway to control traffic, as well as display other useful information (e.g., next rest area). For example, sign-related information may include information on permanent signs relating to speed limits, dangerous intersections, sharp turns, construction zones, railroad crossings, school zones, stop signs, detours, merges, etc. Additionally, and for example, sign-related information may include manually-held signs alerting drivers of construction, lane changes, accidents, detours, etc. Further, sign-related information may be provided on vehicles, such as, for example, a stop sign on a school bus, a slow vehicle sign on slow moving vehicles and a wide load sign on larger vehicles. This sign-related information is intended to control traffic, prevent accidents and provide drivers with useful information.

The size, shape, color, and positioning of traffic control signs to provide sign-related information is typically selected to maximize visibility by drivers. However, external factors may affect the effectiveness of providing this information to drivers. For example, elderly drivers may not see or process the information on a traffic control sign as readily as younger drivers. Further, sleepiness and/or driver fatigue may result in a loss of attention to the information provided on traffic control signs. In other instances, environmental factors may affect the effectiveness of providing this information. For example, hilly terrain or outgrowth of plants and trees may obscure traffic control signs from a driver, thereby resulting in the information on the sign never being seen by a driver or seen too late. Weather conditions also may obscure traffic control signs and, for example, limit the distance from which a driver can view the information on a sign.

Additionally, depending on the driver and vehicle, the placement or positioning of traffic control signs may not provide drivers with enough warning regarding an upcoming condition (e.g., sharp curve or lane closed ahead) to allow the driver to properly react to the information posted on the traffic control sign. Also, the spacing between traffic control signs may not allow for proper response by a driver, for example, if the traffic control signs are too close together or too far apart. Further, there is typically no means to provide information to a driver if the driver, for example, does not see a traffic control sign (e.g., driver fails to see a sharp curve sign) and passes the sign. Also, there is typically no means to provide information to a driver relating to a traffic control sign based on upcoming conditions (e.g., work zone ahead posted on a traffic sign with a stopped vehicle in the work zone). Many traffic control signs include permanent posted information that provide only static information without the ability to provide updated information to the driver.

Thus, the effectiveness of traffic control signs to provide information to drivers is often reduced by factors or circumstances such as the placement or positioning of the signs, driver incompetence, driver age, indifference or inattention, roadway limitations or impairments and/or weather conditions. Reduction or limitation of the ability to view these signs, as well as improper positioning of these signs, decreases the effectiveness of the signs and may increase the likelihood of accidents or other undesirable or unintended consequences. Further, many signs do not provide adequate notice regarding upcoming conditions because of the permanent nature of the signs.

BRIEF DESCRIPTION OF THE INVENTION

According to an exemplary embodiment, a method for communicating information using traffic control signs is provided. The method includes wirelessly transmitting at least one of traffic control information and vehicle information from a traffic control sign and wirelessly receiving the information transmitted from the traffic control sign by at least one other traffic control sign.

According to another exemplary embodiment, a method for controlling traffic is provided and includes wirelessly receiving vehicle information relating to a vehicle by at least one traffic control sign from at least one vehicle. The method further includes determining response information to communicate to the at least one vehicle based on the received vehicle information and information received from at least one other traffic control sign. The method also includes wirelessly communicating the response information to the at least one vehicle.

According to yet another exemplary embodiment, a wireless traffic control system is provided and includes a plurality of traffic control signs configured to wirelessly communicate information therebetween. The information includes at least one of traffic control information and vehicle information.

DETAILED DESCRIPTION OF THE INVENTION

Figure 1:
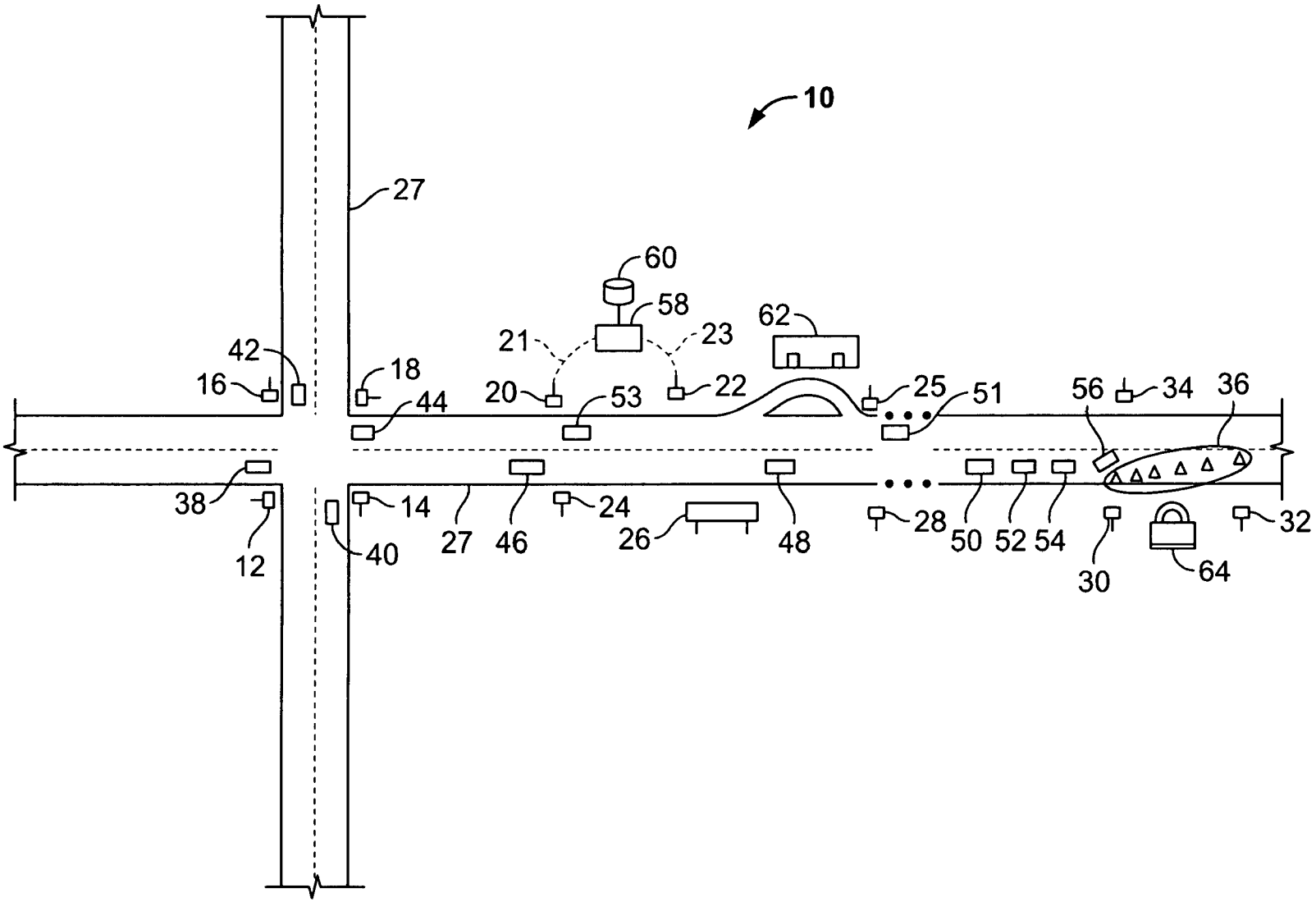
FIG. 1 is a diagram illustrating wireless communication within a wireless traffic control system in accordance with an exemplary embodiment of the invention.

FIG. 1 illustrates an exemplary embodiment of a wireless traffic control system 10 providing wireless communication of information between a plurality of traffic control signs. The wireless traffic control system 10 generally includes a plurality of traffic control signs configured to wirelessly communicate information therebetween. For example, as shown in FIG. 1, traffic control signs 12, 14, 16, 18, 20, 22, 24, 25, 26, 28, 30, 32 and 34, and hazard zone artifacts 36 (e.g., traffic cones) together form a wireless network for communicating information between the traffic control signs and hazard zone artifacts. In operation, traffic control signs 12, 14, 16, 18, 20, 22, 24, 25, 26, 28, 30, 32 and 34, and hazard zone artifacts 36 may wirelessly transmit and receive vehicle information and/or traffic control information between each other, which may include information about the vehicles on the roadway 27 that is received from the vehicles as described in more detail herein.

It should be noted that the hazard zone artifacts 36 generally include, but are not limited to, any type of equipment and artifacts for controlling traffic, such as, for example, flashing road barricades, vehicles with flashing or non-flashing signs warning of hazards, and lane divider cones and barrels located in and near traffic construction zones and hazard areas. These hazard zone artifacts 36 may, for example, have a distinguishing orange or red color, and flashing hazard warning lights may be flashing an amber or yellow color. The traffic control signs, including, for example, traffic signs 12, 14, 16, 18, 20, 22, 24, 25, 26, 28, 30, 32 and 34, and hazard zone artifacts 36, generally include, but are not limited to, non-self-illuminating traffic control signs and self-illuminating traffic control signs, traffic control lights, billboards, and signs designating food and rest areas. In general, when used herein, traffic control signs refer to, but are not limited to, regulatory signs (e.g., stop signs), warning signs (e.g., sharp curve signs), marker signs (e.g., highway designation signs), guide and information signs (e.g., next exit signs), recreational and cultural interest signs (e.g., campground signs), construction signs (e.g., road work ahead signs), railroad crossing signs and school signs. For example, traffic control signs 12, 14, 16, and 18 may be stop signs at a 4-way stop intersection, traffic control sign 25 may be a sign advertising a rest area 62 with restroom facilities, and traffic control sign 30 may be a sign advertising an area providing food and beverages (e.g. a fast food restaurant 64). Further, traffic control sign 26 may be a billboard sign displaying advertising or information regarding an upcoming set of highway inter-exchanges and routes.

Vehicles 38, 40, 42, 44, 46, 48, 50, 51, 52, 53, 54 and 56, which may be capable of transmitting vehicle information to and receiving traffic control information from traffic control signs 12, 14, 16, 18, 20, 22, 24, 25, 26, 28, 30, 32 and 34, and hazard zone artifacts 36, traverse the roadways 27. Vehicle information may include, for example, vehicle identification information (e.g., VIN number or license plate), vehicle speed, vehicle direction, and/or vehicle location. The traffic control information 26 may include, for example, speed limit information, hazard information, warning information, alerting information, upcoming attraction information, etc. The information may be transmitted as messages for providing information to a driver, and may include, for example, messages of excessive speed warning, sharp turn, dangerous intersection, road construction ahead, stopped traffic ahead, road hazard conditions collision imminent, restaurants available at next exit, rest area at next exit, etc. The traffic control information also may relate to received vehicle information. One method for transmitting and receiving information from and to a vehicle is described in co-pending U.S. application entitled "System and Method to Wirelessly Communicate Information Between Traffic Control Signs and Vehicles" referenced above.

In another embodiment, speed and direction of a vehicle, for example, vehicle 46 may be measured by wireless traffic control system 10. For example, the time the vehicle 46 is communicating with that traffic control sign 24 can be recorded and stored. Thereafter, the time also can be recorded when the same vehicle 46, which may be identified, for example, by the transmitted VIN, is communicating with another traffic control sign 28, which also is communicating with the first traffic control sign 24. Using a known distance between the two traffic control signs 24 and 28 and using the distance between two transmission beam points on the roadway 27, the average speed between the two points for the vehicle 46 may be calculated, and may be used to approximate the instantaneous speed of the vehicle. Thus, in operation a radar speed determination may be provided by emitting a pulse from the traffic control sign 24 and 28 and timing the return of the pulse from a vehicle 24. In another exemplary embodiment, a Doppler speed determination may be provided by determining a shift in frequency of the return pulse. Speed tracking capabilities are thereby provided. The direction of the vehicle 46 also may be determined based on transmission beam points on the roadway 27 and using different transmitters and receivers as described herein.

Vehicle information received from vehicles 38, 40, 42, 44, 46, 48, 50, 51, 52, 53, 54 and 56 may be processed by traffic control signs 12, 14, 16, 18, 20, 22, 24, 25, 26, 28, 30, 32 and 34, and hazard zone artifacts 36, to generate traffic control information and/or response information as described in more detail herein. It should be noted that the received information may be processed in combination with stored or previously received information to generate the traffic control information and/or response information.

Referring again to FIG. 1, one or more controllers, for example a computer system 58, may communicate with one or more traffic control signs, for example, traffic control signs 20 and 22 via communication links 21 and 23. Communication links 21 and 23 may be wired or wireless connections. Computer system 58 also may be connected to a storage member, such as, for example, a data repository 60, which may include, for example, one or more databases. Computer system 58 and data repository 60 are used to access stored information, for example, predetermined criteria for use in processing received vehicle information (e.g., to determine if a vehicle has exceeded a speed limit posted on a traffic control sign), as well as for storage of traffic control information and vehicle information (e.g., historical data). In one exemplary embodiment, the computer system 58 and data repository 60 are located remote from the traffic control signs.

The wireless traffic control system 10 including the network of wireless traffic signs 12, 14, 16, 18, 20, 22, 24, 25, 26, 28, 30, 32 and 34, and hazard zone artifacts 36, provides various different functionality for use in controlling traffic on the roadways 27. For example, traffic control information may be transmitted to vehicles for providing information to the drivers of the vehicles (e.g., displayed within a vehicle). Transmission of traffic control information to a vehicle allows the information to be provided to occupants of the vehicle, for example, before the occupants see the traffic control signs, if the occupants cannot see the traffic control signs because of an obstruction or weather conditions, and after the vehicle has passed the traffic control sign. Also, information based on traffic conditions (e.g., a stopped car ahead) and relating to a traffic control sign also may be provided.

As an example, vehicle 46 may be exceeding the speed limit posted on traffic control sign 24. Traffic control sign 24 may receive from vehicle 46 the speed of vehicle 46 or, alternatively, may calculate the speed of vehicle 46. In response to receiving speed information from the vehicle 46 or determining the vehicle speed as described herein, and determining that the speed of the vehicle exceeds the speed limit posted on the traffic control sign 24, traffic control information is transmitted to vehicle 46, indicating that vehicle 46 is exceeding the speed limit. This traffic control information may be provided to the occupant of the vehicle 46 as a visual, audible or tactile notification. For example, a "exceeded posted speed limit" notification may be displayed on a screen within the vehicle 46 (e.g., on a display screen of a navigation system) or output from the vehicle speakers.

As another example, vehicle 46 may not be exceeding the speed limit, but may be driving in fog or a snowstorm. Even though not exceeding the speed limit, vehicle 46 may be too close to vehicle 48 whereby a collision is imminent. Traffic control sign 24 may receive from vehicle 46 the speed of vehicle 46 and wirelessly transmit this speed information to traffic control sign 28. Traffic control sign 28 also may be receiving speed information from vehicle 48 and determine that vehicle 46 is approaching vehicle 48 too fast for the distance between the vehicles 46 and 48 such that a collision may be imminent. This determination is based on received and/or calculated speed information from the vehicles 46 and 48 and stored information regarding the location of the traffic control signs 24 and 28. The distance between the traffic control signs 24 and 28, and additionally, location information for the vehicles 46 and 48 (e.g., received from in-vehicle navigation systems) may also be used. Traffic control sign 28 may then transmit traffic control information to traffic control sign 24, which further transmits a message to vehicle 46 indicating the potential for collision. Vehicle 46 then may display, audibly output or tacitly output a notification of the upcoming condition. For example, a "slow speed," "slower vehicle ahead" or "reduce speed" notification may be provided to the occupants of the vehicle 46.

As yet another example, traffic control sign 30 may be receiving vehicle information from vehicle 54 indicating that vehicle 54 is stopped or traveling at a very low speed. Traffic control sign 30 also may receive vehicle information from other nearby traffic control signs (not shown in FIG. 1) about other vehicles (e.g. vehicles 50 and 52) or directly from the vehicles 50 and 52 depending on whether the vehicles 50 and 52 are within communication range of the traffic control sign 30 or another traffic control sign. Based upon the received information, a determination may be made, for example, based upon received vehicle speed information and stored information (e.g., posted speed limit and distance between traffic control signs), that highway traffic congestion is occurring. Traffic control sign 30 may then transmit via a chain of other traffic control signs (not shown in FIG. 1) information relating to the traffic congestion condition ahead to traffic control sign 28. Traffic control sign 28 may then transmit traffic congestion information to the occupants of vehicle 48. For example, a visual, audible or tactile notification may be provided to the occupants of the vehicle 48, such as, a "congestion ahead," "slow moving traffic" or "seek alternate route" notification.

As still another example, traffic control sign 30 may transmit to vehicle 54 information about upcoming services, for example, a set of upcoming restaurants (e.g., fast food restaurant 64). As another example and referring to traffic control signs 12, 14, 16, and 18, these traffic control signs control vehicle movement at a 4-way intersection by providing a 4-way stop. Vehicle 40 may be proceeding through the traffic control sign 14 at the same time vehicle 44 is making a left turn. Speed and direction information may be received by traffic control sign 14 regarding vehicle 40 and by traffic control sign 18 regarding vehicle 44. Traffic control signs 14 and 18 (that are in communication) can then process the received information to determine that a collision is imminent. This information may be processed by processors within the traffic control signs 14 and 18, as described in more detail herein, or may be processed at a central processing facility. In this example, and based upon the processed information, traffic control sign 14 may provide a notification to vehicle 40 and traffic control sign 18 may provide a notification to vehicle 44 that a collision is imminent (e.g., "vehicle entering intersection" notification).

Received information may also be processed and traffic control information may be provided using the computer system 58 and the data repository 60. The computer system 58 and the data repository 60 generally may provide a database system for storage and retrieval of information, including previously and/or currently received vehicle information, data relating to traffic control signs (e.g., information posted on each traffic control sign, location of the traffic control signs, distance between the traffic control signs, current operating status of the traffic control signs, etc.) and predetermined criteria for generating traffic control information (e.g., a predetermined list of notifications to be transmitted to vehicles based upon received vehicle information). Some of this information also may be stored within memory in the traffic control signs. For example, traffic control signs 20 and 22 may transmit available traffic control information, which may be transmitted via a wired or wireless link, to the computer system 58 for storage in the data repository 60. Alternatively, traffic control signs 20 and 22 may transmit requests and/or queries to obtain information from the data repository 60 via the computer system 58 (e.g., request for last received information for a vehicle or operating status of a traffic control sign failing to respond to another traffic control sign).

As an example, the computer system 58 and the data repository 60 may be used to locate a vehicle involved in a crime (e.g., a stolen vehicle or a vehicle involved in a kidnapping). Vehicle 53 may transmit vehicle identification information to traffic control sign 20, which may further communicate the received identification information to the computer system 58. The computer system 58 may then search the data repository 60 to determine whether information matching the received vehicle identification information is stored within the data repository 60, for example, indicating that vehicle 53 is involved in a crime. The computer system 58 may communicate the location of vehicle 53, which location may be determined either directly from vehicle 53 as part of its vehicle information (e.g., in-vehicle navigation system) or from the location of traffic control sign 20, to police systems (not shown in FIG. 1) to alert police of the location of vehicle 53.

As another example, the driver of vehicle 53 may have an emergency situation (e.g. may have collided with another vehicle, or may be in need of roadside assistance for changing a flat tire). The driver of vehicle 53 may activate a button (e.g., emergency button) within vehicle 53 that causes the transmission of emergency information about vehicle 53 as part of the vehicle information transmitted to traffic control sign 20. The driver of vehicle 53 may be able, for example, to select from a predetermined list of possible messages to transmit as displayed on a display within the vehicle as described herein. Traffic control sign 20 then may transmit the emergency information to the computer system 58 for the computer system 58 to communicate to the proper entities (not shown in FIG. 1) in order for vehicle 53 to obtain the assistance needed.

As other examples, the network of traffic control signs 12, 14, 16, 18, 20, 22, 24, 25, 26, 28, 30, 32 and 34, and hazard zone artifacts 36 all may provide information to the computer system 58, which may be provided directly or through a chain of traffic control signs. The computer system 58 may then access data repository 60 and process the received information to generate, for example, reports of traffic accident patterns or reports on traffic patterns in general. It should be noted that not all of the traffic control signs 12, 14, 16, 18, 20, 22, 24, 25, 26, 28, 30, 32 and 34, and hazard zone artifacts 36, may be connected to the computer system 58. However, traffic control information obtained at any one traffic control sign (e.g. traffic control sign 30), may be wirelessly transmitted from one traffic sign to another until received by traffic control signs 20 and 22. Traffic control signs 20 and 22 then may communicate the information received to the computer system 58 and which may be stored in the data repository 60. Thus, the traffic control information available at any one traffic control sign may be made available to other traffic control signs (via wireless communication between traffic control signs) comprising the network of traffic control signs.

It should be noted that the information received, processed and communicated using wireless traffic control system 10 is not limited to the information, processing and communication described in the examples. The wireless traffic control system 10 may be used to receive, process and communicate any information relating generally to traffic control.

Figure 2:
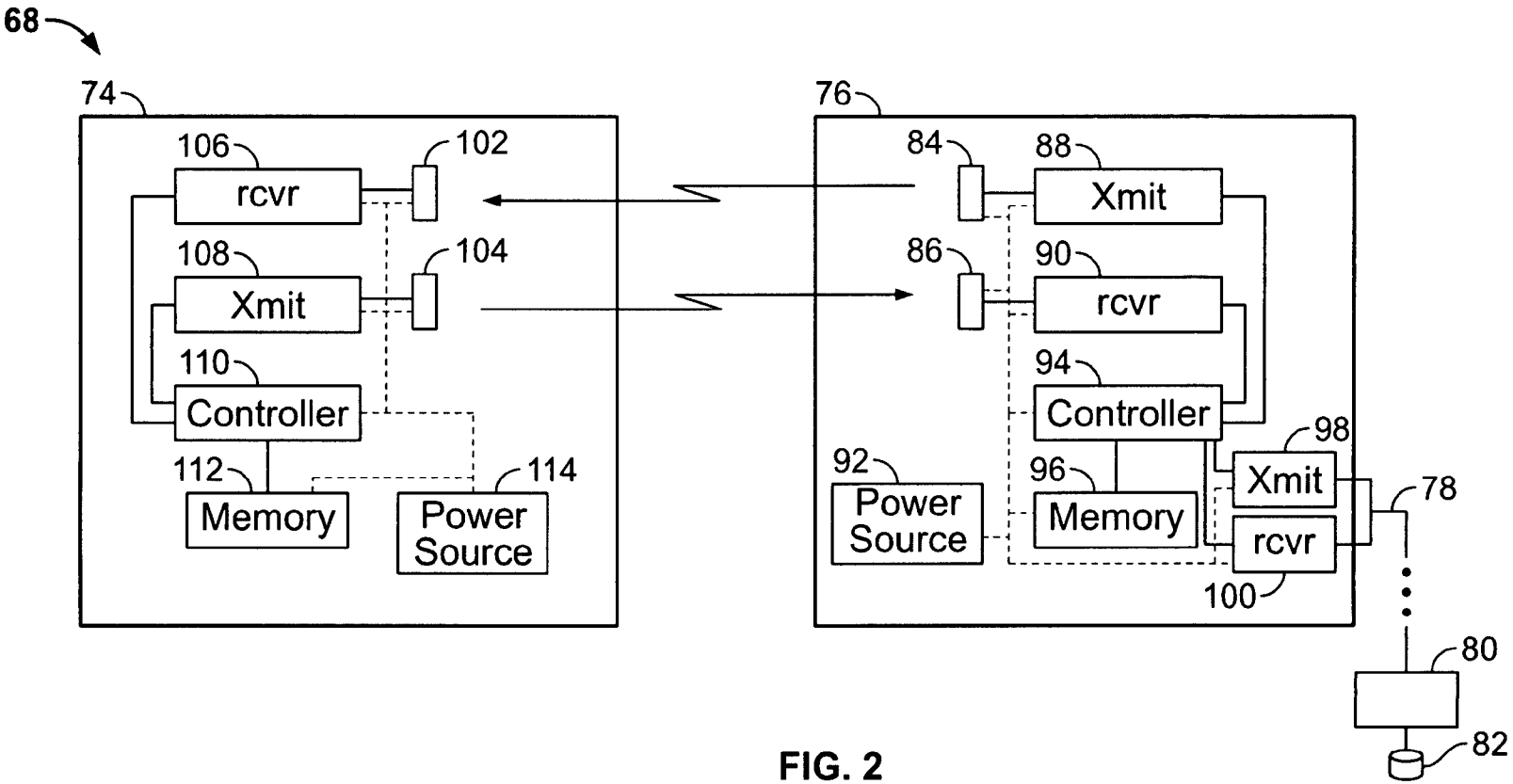
FIG. 2 is a block diagram of a wireless traffic control system in accordance with an exemplary embodiment of the invention.
Figure 3:
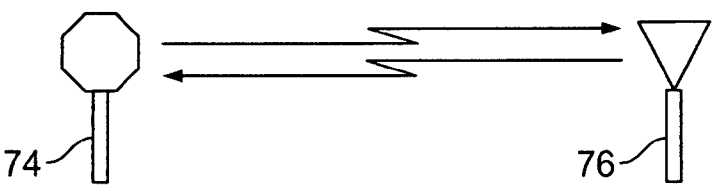
FIG. 3 is a diagram illustrating a configuration for communicating information between traffic control signs in accordance with an exemplary embodiment of the invention.

FIG. 2 is a block diagram illustrating an exemplary embodiment of a system 68 of traffic control signs 74 and 76 (shown in FIG. 3) that may be used in the wireless traffic control system 10. It should be noted that any traffic control sign in the wireless traffic control system 10, including, for example, traffic control signs 12, 14, 16, 18, 20, 22, 24, 25, 26, 28, 30, 32 and 34, may be configured in a similar manner. As shown in FIG. 2, the two traffic control signs 74 and 76 are configured for wireless communication and may be formed physically as any type of sign. For example, and as shown in FIG. 3, traffic control sign 74 may be formed physically as a stop sign and traffic control sign 76 may be formed physically as a yield sign, and which are configured to wirelessly communicate as described below. Further, in one exemplary embodiment, each traffic control sign and/or vehicle has associated therewith a unique identifier (e.g., identification number), which may be used when communicating information to determine, for example, from which sign(s) and to which sign(s) the information is to be communicated (e.g., source of and destination for the communicated information).

Specifically, and in one exemplary embodiment, traffic control sign 74 generally includes a receiver antenna 102 connected to a receiver 106 and a transmitter antenna 104 connected to a transmitter 108. In another embodiment, a combined transmit/receive antenna and transceiver are provided. Receiver 106 and transmitter 108 are connected to a controller 10, which controls the operation of receiver 106 and transmitter 108. Controller 110 may be, for example, a microprocessor with associated memory 112, or other processing and memory unit. Power source 114 is provided to power the components of traffic control sign 74 and may be configured as solar cells that provide solar power and/or batteries that provide power to operate the components of traffic control sign 74. If both solar and battery power is provided, in operation, when sunlight is available, the energy from solar cells may power the traffic control sign 74 and recharge a storage battery. When sunlight is not available, the traffic control sign 74 may be powered from stored solar power or from another installed power supply (e.g., replaceable battery).

Traffic control sign 76 includes a receiver antenna 86 connected to a receiver 90 and a transmitter antenna 84 connected to a transmitter 88. In another embodiment, a combined transmit/receive antenna and transceiver are provided. Receiver 90 and transmitter 88 are connected to controller 94, which controls the operation of receiver 90 and transmitter 88. Controller 94 may be, for example, a microprocessor with associated memory 96, or other processing and memory unit. Power source 92 is provided to power the components of the traffic control sign 76 and may be configured as solar cells that provide solar power and/or batteries that provide power to operate the components of traffic control sign 76. If both solar and battery power is provided, in operation, when sunlight is available, the energy from solar cells may power the traffic control sign 76 and recharge a storage battery. When sunlight is not available, the traffic control sign 76 may be powered from stored solar power or from another installed power supply (e.g., replaceable battery).

Traffic control sign 76 also may be connected via communication link 78 to a computer system 80 that is connected to a data repository 82. Communication to and from the computer system 80 may be provided with transmitter 98 and receiver 100. The computer system 80 along with data repository 82 provides for storage and retrieval of information by the traffic control signs as described herein.

As used herein, the term "computer" or "computer system" may include, but is not limited to, any processor-based or microprocessor-based system, including systems using microcontrollers, reduced instruction set circuits (RISC), application specific integrated circuits (ASICs), logic circuits, and any other circuit or processor capable of executing the functions and operation described herein.

Figure 4:
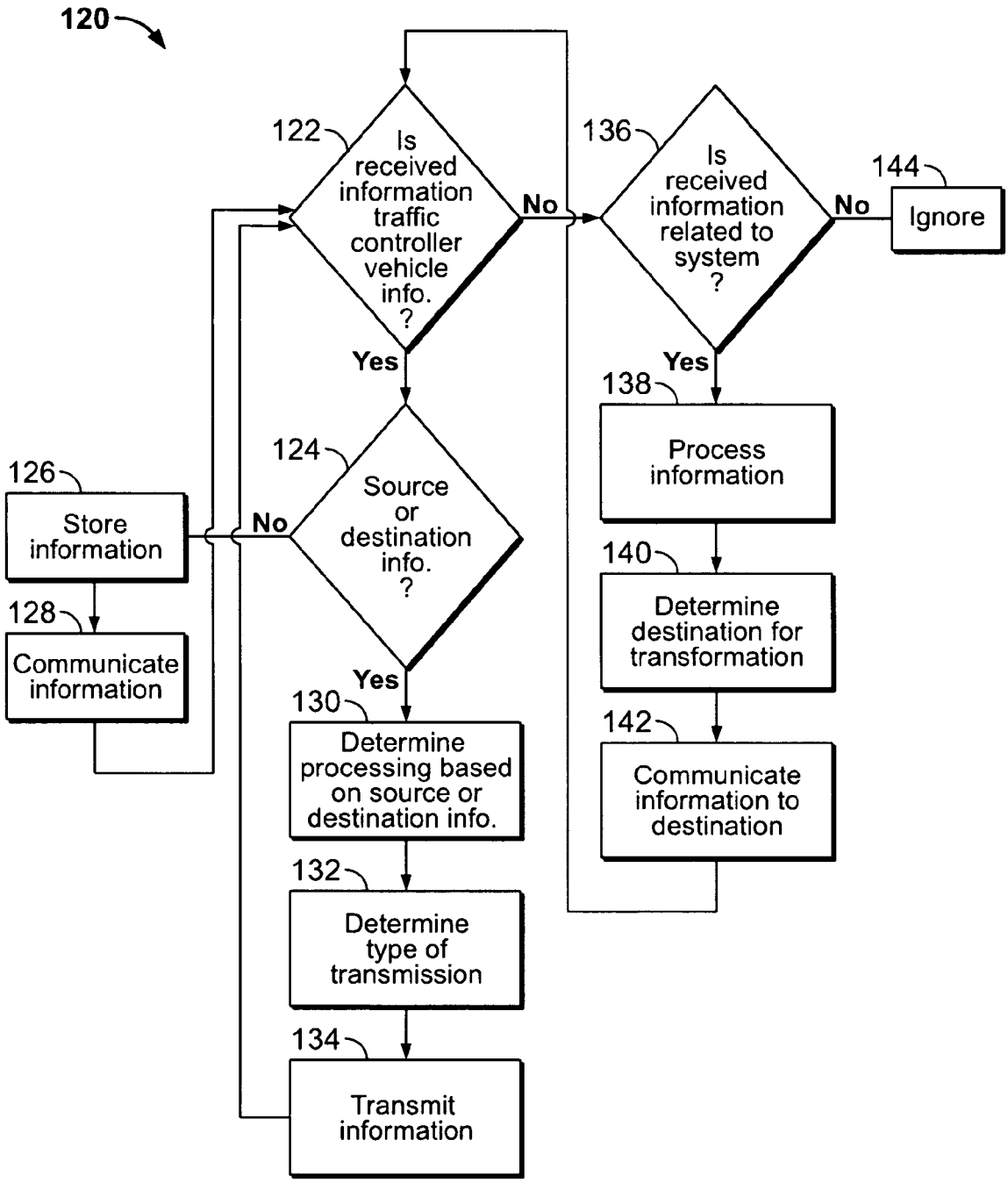
FIG. 4 is a flowchart in accordance with an exemplary embodiment of the invention illustrating a method for communicating information within the wireless traffic control system of FIGS. 1 and 2.

As shown in FIG. 4, and with reference to the wireless traffic control system 10 shown in FIGS. 1 and 2, a method 120 provides for communication of information within the wireless traffic control system 10 and communication of information between the wireless traffic control system 10 and vehicles. Specifically, at 122 a determination is made by a traffic control sign whether information received is either traffic control information (e.g., from another traffic control sign) or vehicle information (e.g., from a vehicle or through another traffic control sign). If the received information is either traffic control information or vehicle information, a determination is made at 124 whether source information (e.g., unique identifier regarding source of the information) and/or destination information (e.g., a destination traffic control sign) is provided in connection with the received information. If source and/or destination information is not received, the traffic control sign stores the information at 126, for example, in a memory within the traffic control sign. The information may then be communicated at 128, for example, to other systems, such as a computer, central database system, or to an appropriate entity.

If at 124 a determination is made that source and/or destination information is available, then at 130 a determination is made as to the processing required for the information based on the source and/or destination information. For example, if the information is vehicle speed information, the vehicle speed may be compared to a stored speed limit and then a response generated for transmission to the vehicle (e.g., an "excessive speed" notification). This information also may be stored within a memory of the traffic control sign. As another example, if the information is traffic control information or vehicle information from another traffic control sign, the information may be processed to determine a response or routing requirements for the information. Specifically, if the information is traffic control information (e.g., vehicle exceeding speed) from another traffic control sign, the information may be processed to determine if a vehicle within the range of the processing traffic control sign is travelling at a slower speed. If so, a notification may be sent to the other traffic control sign to be transmitted to the vehicle exceeding the posted speed limit to provide a warning indication to the slower vehicle (e.g., slow vehicle ahead). If the information is vehicle information from another traffic control sign, the information again may be processed to determine if a notification should be transmitted to a vehicle within the transmission range of the traffic control sign or if a notification should be communicated to the other traffic control sign for transmission to a vehicle within the transmission range of the other traffic control sign. Thus, the received information may be processed, stored and/or routed accordingly.

After processing the information, a determination is made at 132 as to the type of transmission to be provided. For example, if the information, such as traffic control information, is to be transmitted to a specific vehicle or a specific sign, a focused transmission beam communication may be provided as described below. Further, and for example, if the information, such as vehicle information, is to be transmitted to a plurality of traffic control signs, then a broadcast transmission may be provided as described below. Additionally, and for example, if the information, such as traffic control information, is to be transmitted to a plurality of vehicles, then a broadcast transmission is provided. Thereafter, the information is transmitted at 134 based upon the determined type.

If at 122 a determination is made that the received information is not traffic control information or vehicle information, then at 136 a determination is made as to whether the received information is related to the wireless traffic control system 10 (e.g., operational status request transmission). If the received information is related to the wireless traffic control system 10 then at 138 the information is processed. For example, a system check may be performed based on the received information. Thereafter, at 140 a determination is made as to a destination for any information resulting from the processing. For example, if a system check is performed, the destination is the requesting entity (e.g., central control entity). The information is then communicated (e.g., transmitted) at 142 to the determined destination.

If at 136 a determination is made that the received information is not related to the wireless traffic control system 10, then at 144 the received information is ignored.

In operation, and with reference to traffic control signs 74 and 76, transmitter antenna 84 of traffic control sign 76 may transmit information, for example, vehicle and/or traffic control information to receiver antenna 102 of traffic sign 74. Further, transmitter antenna 104 of traffic sign 74 may transmit vehicle and/or traffic control information to receiver antenna 86 of traffic sign 76. The wireless communication of vehicle and/or traffic control information between traffic control signs may be performed on at least one of a plurality of frequencies within a predetermined frequency range. The predetermined frequency range for wireless communication between traffic control signs may be different than the predetermined frequency range for wireless communication between a vehicle and a traffic control sign. One method for communicating information between a plurality of traffic control signs and between traffic control signs and vehicles, as well as different configurations for antennas (including providing a housing forming part of the traffic control sign with the housing having an antenna integrally formed therein) are described in co-pending U.S. application entitled "System and Method to Wirelessly Communicate Information Between Traffic Control Signs and Vehicles" referenced above. Thus, for example, a more directive or focused transmission link (e.g., a 24 GHz millimeter-wave (MMW) transmission link) may be used to communicate information that is to be transmitted to a particular vehicle or a particular traffic control sign. A broadcast communication link (e.g., 5.8 GHz or 2.4 GHz link) may be used to communicate information that is to be broadcast to a plurality of vehicles or communicated to a plurality of traffic control signs.

Thus, a wireless traffic control system 10 and method for wirelessly communicating information between a plurality of traffic control signs and between a plurality of traffic control signs and a plurality of vehicles is provided. The various embodiments are configured to receive vehicle information by at least one of the traffic control signs from a vehicle. The received vehicle information and/or other stored information is used to provide traffic control information or response information. For example, traffic control information in the form of notifications or messages may be transmitted between traffic control signs and/or to vehicles (e.g., excessive speed, stopped traffic ahead, road condition hazards, road construction ahead, slow speed, and collision imminent notifications).

Additionally, the wireless traffic control system 10 may include a computer system with a data repository (e.g., a database system) that may be used to store information received from a plurality of traffic control signs, for example, within a predetermined area or traffic grid. This information then may be used to control traffic flow by determining traffic patterns in the area. The information also may be used to prevent or reduce accidents by determining accident patterns. Further, the information may be used, for example, to locate vehicles involved in crime situations, and to locate vehicles in need of assistance.

Further, using a plurality of traffic control signs, traffic control information may be communicated to determine situations or conditions for which a vehicle driver should or may be notified. Further, the various embodiments may be implemented and configured as any type or kind of traffic control sign. For example, the various embodiments may be configured as a known traffic signs (e.g., stop or speed limit signs) that wirelessly communicate information.

While the invention has been described in terms of various specific embodiments, those skilled in the art will recognize that the invention can be practiced with modification within the spirit and scope of the claims.

What is claimed is:

1. A method for communicating information using traffic control signs, said method comprising:

wirelessly transmitting at least one of traffic control information and vehicle information from a traffic control sign; and wirelessly receiving the information transmitted from the traffic control sign by at least one other traffic control sign, and wherein wirelessly transmitting further comprises wirelessly transmitting information on at least one of a first plurality of frequencies within a predetermined range when transmitting to other traffic control signs and wirelessly transmitting information on at least one of a second plurality of frequencies within a predetermined range when transmitting to vehicles.

2. A method in accordance with claim 1, further comprising at least one of (i) processing the received information to determine response information to wirelessly transmit, (ii) storing the received information and (iii) communicating the information to at least one of another traffic control sign and a vehicle.

3. A method in accordance with claim 1, further comprising wirelessly receiving the transmitted information in at least one vehicle.

4. A method in accordance with claim 1, wherein wirelessly transmitting comprises wirelessly broadcasting the information to a at least one of (i) a plurality of other traffic control signs and (ii) a plurality of vehicles.

5. A method in accordance with claim 1, wherein wirelessly transmitting comprises transmitting the information to a single vehicle using a focused transmission beam.

6. A method in accordance with claim 1, further comprising accessing stored information to determine a response to transmit based on the received information.

7. A method in accordance with claim 1, further comprising determining at Least one of a source and destination of the received information based on a unique identifier.

8. A method in accordance with claim 1, further comprising wirelessly transmitting vehicle information from at least one vehicle to at least one traffic control sign.

9. A method in accordance with claim 8, further comprising determining information to transmit to at least one other traffic control sign based on the received vehicle information.

10. A method in accordance with claim 9, further comprising transmitting notification information from a traffic control sign to a vehicle based on information received by another traffic control sign from another vehicle.

11. A method for controlling traffic, said method comprising:

wirelessly receiving vehicle information relating to a vehicle by at least one traffic control sign from at least one vehicle;

determining response information to communicate to the at least one vehicle based on the received vehicle information and information received from at least one other traffic control sign; and wirelessly communicating the response information to the at least one vehicle.

12. A method in accordance with claim 11, further comprising wirelessly communicating the response information to at least one other traffic control sign.

13. A method in accordance with claim 11, wherein determining response information further comprises using one of stored vehicle information or traffic control information.

14. A method in accordance with claim 11, further comprising wirelessly communicating the response information to at least one other vehicle.

15. A method in accordance with claim 11, further comprising wirelessly communicating at least one of the received vehicle information and traffic control information to at least one other traffic control sign.

16. A wireless traffic control system comprising:

a plurality of traffic control signs configured to wirelessly communicate information therebetween, the information including at least one of traffic control information and vehicle information, and wherein the plurality of traffic control signs are further configured to wirelessly transmit information on at least one of a first plurality of frequencies within a predetermined range when transmitting to other traffic control signs and to wirelessly transmit information on at least one of a second plurality of frequencies within a predetermined range when transmitting to vehicles.

17. A wireless traffic control system in accordance with claim 16, further comprising at least one vehicle receiver configured to receive the information communicated from at least one of the plurality of traffic control signs.

18. A wireless traffic control system in accordance with claim 16, further comprising at least one vehicle transmitter for transmitting vehicle information to at least one of the traffic control signs.

19. A wireless traffic control system in accordance with claim 16, wherein the plurality of traffic control signs comprise at least one of a regulatory sign, warning sign, marker sign, guide and information sign, recreational and cultural interest sign, construction sign, railroad crossing sign and school sign.

20. A wireless traffic control system in accordance with claim 16, wherein the plurality of traffic control signs include a housing and wherein the housing comprises an antenna integrally formed therein.

* * * * *